US005078571A

United States Patent [19]

Meylan

[11] Patent Number: 5,078,571

[45] Date of Patent: Jan. 7, 1992

[54] MULTI-CYLINDER STEAM TURBINE

[75] Inventor: Pierre Meylan, Neuenhof, Switzerland

[73] Assignee: BBC Brown Boveri AG, Baden, Switzerland

[21] Appl. No.: 630,735

[22] Filed: Dec. 20, 1990

Related U.S. Application Data

[63] Continuation of Ser. No. 283,836, Dec. 13, 1988, abandoned.

[30] Foreign Application Priority Data

Dec. 17, 1987 [DE] Fed. Rep. of Germany ..... 3742814

[51] Int. Cl.[5] ..... F01D 13/02

[52] U.S. Cl. ..... 415/66; 415/108; 415/134

[58] Field of Search ..... 415/66, 67, 108, 136, 415/138, 134, 213.1, 215.1, 232

[56] References Cited

U.S. PATENT DOCUMENTS

| | | | |
|---|---|---|---|
| 1,684,082 | 9/1928 | Allen | 415/66 |
| 2,992,809 | 7/1961 | Herbage | 415/134 X |
| 3,594,095 | 7/1971 | Trassel et al. | 415/108 |
| 3,773,431 | 11/1973 | Bellati | 415/108 |
| 4,029,432 | 6/1977 | Meylan | 415/108 |
| 4,326,832 | 4/1982 | Ikeda et al. | 415/108 |
| 4,744,726 | 5/1988 | Remberg | 415/213.1 X |

FOREIGN PATENT DOCUMENTS

| | | | |
|---|---|---|---|
| 641226 | 5/1962 | Canada | 415/134 |
| 1216322 | 5/1966 | Fed. Rep. of Germany . | |
| 1332075 | 6/1963 | France . | |
| 1145612 | 3/1969 | United Kingdom . | |

OTHER PUBLICATIONS

"Moderne westdeutsch Gross-Dampfturbinen", pp. 173-181, 1958, Konstruktion, Author: A. Leitner.

*Primary Examiner*—John T. Kwon

*Attorney, Agent, or Firm*—Burns, Doane, Swecker & Mathis

[57] ABSTRACT

In this multi-cylinder steam turbine, compensation is provided for the axial thermal expansion, from the bearing housing (5) of the medium pressure partial turbine (1), of the low pressure part of the shafting (4) by the low pressure steam feed pipe (15, 16) rigidly connected to the medium pressure partial turbine (1) being rigidly connected to the inner casing (11, 12) of the two-casing low pressure partial turbines (2, 3). Because of the equal temperatures, the part of the shafting (4) mentioned and the low pressure steam feed pipes (15, 16) expand equally so that the axial clearances between the nozzle guide vane and rotor blade rings of the low pressure partial turbines (2, 3) are also substantially retained. The otherwise conventional connecting elements between the medium pressure partial turbines and the low pressure partial turbines with their associated sealing problems on the outer casings disappear.

3 Claims, 1 Drawing Sheet

MULTI-CYLINDER STEAM TURBINE

This application is a continuation of application Ser. No. 07/283,836, filed Dec. 13, 1988, now abandoned.

BACKGROUND OF THE INVENTION

1. Field of the Invention

The present invention concerns a multi-cylinder steam turbine, having a high pressure partial turbine, a medium pressure partial turbine and at least one low pressure partial turbine, which low pressure partial turbines are designed with two casings each having one outer casing and one inner casing supported within the outer casing and displaceable relative to it, each also having two low pressure steam feed pipes connecting the medium pressure partial turbine to these inner casings, which low pressure steam feed pipes are fed through the outer casings of the low pressure partial turbines and seal, on these, the outer casing internal space against the atmosphere by means of sealing devices which permit a displacement, parallel to the shafting, of the low pressure steam feed pipes relative to the outer casing, the shafting being located axially in both directions on a thrust bearing arranged between the medium pressure partial turbine and the high pressure partial turbine.

2. Discussion of Background

In multi-cylinder turbines which, in addition to a high pressure partial turbine, have a medium pressure partial tubrine and at least one low pressure partial turbine, measures have to be provided to ensure that the minimum necessary axial clearance is retained during operation between adjacent rotor and stator rings. In turbines of this type, in which the partial turbines are designed as two-casing turbines with an inner casing and an outer casing, such measures generally consist of connecting elements between the inner casing of the medium pressure turbine and the inner casing of the subsequent low pressure turbine and between the inner casing of the latter and the inner casing of and further low pressure partisa turbine and so on, should even more low pressure partial turbines be present. Something in the nature of a bearing position is then arranged between the high pressure partial turbine, referred to for short as the "high pressure part" in what follows, and the medium pressure partial turbine, referred to in what follows as the "medium pressure part", as the location point from which the high pressure part and the medium pressure part, together with the subsequent low pressure parts, can expand unhindered in opposite directions.

A multi-cylinder turbine with such a concept for providing compensation for axial clearance changes due to thermal expansions is described in DE-PS 1,216,322 by Rateau. In this, a single-casing medium pressure part, which is displaced along with its turbine rotor by the thermal expansions, transfers these expansions via coupling rods, which penetrate the outer casing of the two-casing arrangement of the low pressure part to the inner casing, to which they are hinged. The shaft, together with the turbine rotor, is displaced by the same amount as the inner casing, together with its blading, because it has substantially the same temperature as the inner casing so that the axial clearances between the nozzle guide vane and rotor blade rings are retained at practically the same magnitude as in the cold condition. The location point of the shaft, from which—on the one hand—the medium pressure part and the inner casing of the low pressure parts coupled to it can expand and be displaced freely and—on the other hand—the high pressure part can expand and be displaced freely in the opposite direction, is positioned at a bearing position between the high pressure part and the medium pressure part.

In this arrangement, the seals at the penetration positions of the coupling rods through the outer casings of the low pressure parts are problematic. In the patent mentioned, corrugated tubes or bellows or stuffing boxes or the like are proposed but all of these represent a possible fault source.

SUMMARY OF THE INVENTION

Accordingly, one object of this invention is to avoid the abovementioned sealing problems in a multi-cylinder steam turbine and to design the device for maintaining the axial clearances between the nozzle guide vane and rotor blade rings of the low pressure parts in as simple, uncomplicated and operationally reliable a manner as possible.

In the multi-cylinder steam turbine of the invention, the low pressure steam feed pipes are rigidly connected to their respective inner casings in such a way that the thermal expansion of the low pressure steam feed pipes, occurring during operation, displaces the inner casings relative to the outer casings by a distance which is equal to the distance by which the thermal expansion of the shafting displaces the turbine rotors from the thrust bearing, so that the axial clearances between the nozzle guide vane rings in the inner casings and the rotor blade rings of the turbine rotors remain within their permissible range.

DESCRIPTION OF THE PREFERRED EMBODIMENT

Figure 1:
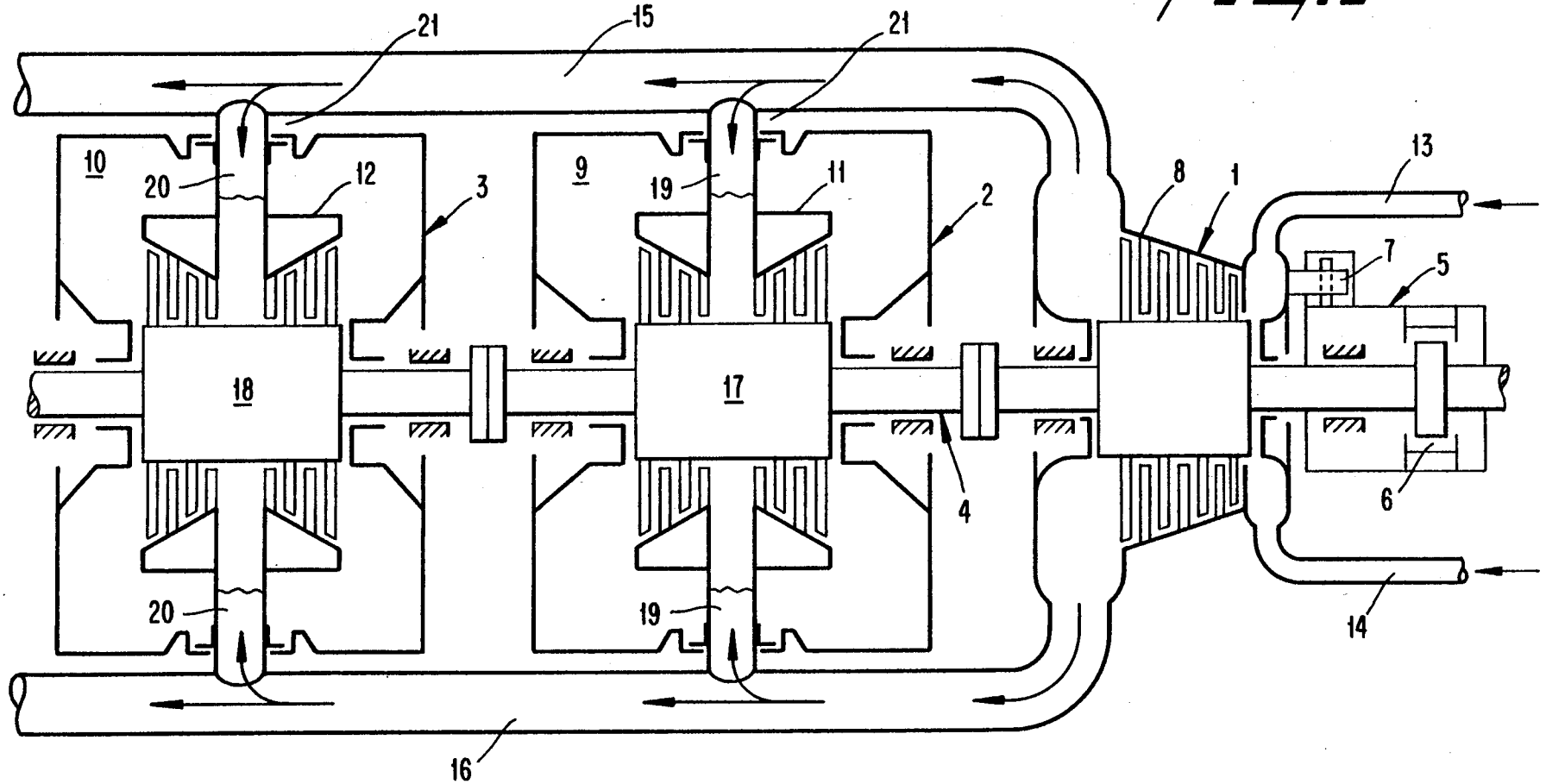
FIG. 1 shows, diagrammatically, a horizontal, longitudinal section, at the level of the shaft centerline, through a multi-cylinder steam turbine with a medium pressure part and several low pressure parts.

Referring now to the illustrative example shown in the single figure of the drawing, the invention is described in more detail below. The high pressure part is not shown.

A medium pressure partial turbine 1, the high pressure partial turbine located to the right of it (not shown) and two or, if appropriate, more low pressure partial turbines 2 and 3 supply their power via common shafting 4 to an electrical generator (not shown) coupled to the left-hand end of the shafting. The shafting 4 is located in both directions by double-sided thrust bearing 6 in a bearing housing a positioned between the high pressure part and the medium pressure part 1. From this location point, the high pressure part can expand unhindered to the right because its casing is displaceably supported, in known manner, by means of support lugs on sliding tracks, tipping about the shaft centerline due to the reaction torque being prevented by a support which forms an axial holding device for the medium pressure casing. The figure shows such a support 7 for the casing 8 of the medium pressure part 1. The casing 8 and the bearing housing 5 are rigidly collected axially to one another.

The outer casings 9 and 10 of the low pressure parts 2 and 3, respectively, are fastened to the base plate and their inner casings 11 and 12 are supported, again in known manner, in their respective outer casings so that they can be displaced axially relative to them and so that they are secured against tipping.

The medium pressure steam pipes 13, 14 leading from the high pressure part to the medium pressure part 1 and the low pressure steam pipes 15, 16 leading to the low pressure parts 2 and 3 are most expediently arranged, in this concept, in such a way that they run on both sides of the partial turbines 1–3 at the level of the shaft centerline. This, at least, is the most advantageous arrangement of the invention in the region of the low pressure parts, however—although it does not exclude other appropriate pipe runs.

The simplification according to the invention—relative to the background of the invention, discussed above—consists in the fact that the displacement of the inner casings 11 and 12 of the low pressure parts 2 and 3, respectively, necessary—because of the thermal expansion of the shafting 4, together with the turbine rotors 17 and 18—to maintain the axial clearances on heating, is achieved by using the very rigid low pressure steam feed pipes 15 and 16 emerging from the medium pressure part 1 instead of coupling rods or other transmission elements between the medium pressure part 1 and the first low pressure part 2 and between the latter and the following low pressure part 3, etc. The steam branch pipes 19 and 20 branching off from these pipes 15 and 16 enter the respective outer casings through sealing devices 21 of known type, which are flexible in the displacement directions, and are rigidly connected to the respective inner casings 11 and 12.

Because the shafting, together with the turbine rotors, reaches substantially the same temperature during operation as the low pressure steam feed pipes, their thermal expansions are also of substantially the same magnitude and, in consequence, the axial clearances between the rotor blade and nozzle guide vane rings remain within the permissible tolerance range.

The advantages of this concept are obvious. Components which are present in any case, fulfil—simultaneously and without any substantial extra expense—the duty of the otherwise additionally necessary connecting elements, e.g. the coupling rods mentioned above, which involve a not unsubstantial extra expense and, in particular, produce a sealing problem additional to those already present.

As already mentioned, the centerlines of the steam feed pipes 15, 16 and the branch pipes 19, 20 will preferably be arranged in a horizontal plane through the centerline of the shafting in order to achieve symmetrical force application. Depending on the space relationships, however, other pipe runs are possible. In this case the sliding guided which permit the displacement of the inner casings relative to the outer casings have to be placed to suit the connection positions of the steam feed pipes to the inner casings.

What is claimed as new and desired to be secured by Letters Patent of the United States is:

1. Multi-cylinder steam turbine comprising, a high pressure partial turbine, a medium pressure partial turbine and at least one low pressure partial turbine, the low pressure partial turbines each have an outer casing and an inner casing supported within the outer casing and displaceable relative to the outer casing, each also having two low pressure steam feed pipes connecting the medium pressure partial turbine to these inner casings, said low pressure steam feed pipes being substantially rigid along the distance between said medium pressure partial turbine and said inner casings, which rigid low pressure steam feed pipes are fed through the outer casings of the low pressure partial turbines and seal, on these, the outer casing internal space against the atmosphere by means of sealing devices which permit a displacement, parallel to a common shafting, of the low pressure steam feed pipes relative to the outer casing, the common shafting being rigidly fixed axially in both directions at a thrust bearing arranged between the medium pressure partial turbine and the high pressure partial turbine, wherein the rigid low pressure steam feed pipes are rigidly connected to their respective inner casings in such a way that the thermal expansion of the low pressure steam feed pipes, occurring during operation, displaces the inner casings relative to the outer casings by a distance which is equal to the distance by which the thermal expansion of the shafting displaces the turbine rotors from the thrust bearing, so that the clearances in the axial direction between the nozzle guide vane rings in the inner casings and the rotor blade rings of the turbine rotors remain within their permissible range.

2. Multi-cylinder steam turbine according to claim 1, wherein the centerlines of the rigid low pressure steam feed pipes are positioned symmetrically on both sides of the outer casings of the low pressure partial turbines in a horizontal plane through the centerline of the common shafting.

3. A multi-cylinder steam turbine comprising a high pressure partial turbine, a medium pressure partial turbine and at least one low pressure partial turbine, the turbines being mounted in axial alignment for rotation about a common shaft which is rigidly fixed in an axial direction from with a thrust bearing between the high pressure partial turbine and the medium pressure partial turbine, the low pressure partial turbines being spaced from the high pressure partial turbine a distance axially of the shaft that is greater than the distance between the medium pressure partial turbine and the high pressure partial turbine;

a pair of steam feed pipes extending from the medium pressure partial turbine in a direction parallel to the common shaft, the steam feed pipes being substantially continuous and without intermediate couplings, the low pressure partial turbines having an inner casing and an outer casing, a pair of low pressure branch pipes rigidly joined to the respective steam feed pipes and extending through the outer casing and into the inner casing, the low pressure feed pipes being rigidly connected with the inner casing, the outer casing having sealing means for sealing around the low pressure feed pipes, the sealing means permitting displacement of the low pressure feed pipes relative to the outer casing, whereby the thermal expansion of the low pressure steam feed pipes, occurring during operation, displaces the inner casings relative to the outer casings by a distance which is equal to the distance by which the thermal expansion of the shafting displaces the turbine rotors from the thrust bearing, so that the clearances in the axial direction between the nozzle guide vane rings in the inner casings and the rotor blade rings of the turbine rotors remain within their permissible range.

* * * * *